US012687073B1

(12) United States Patent
Graham et al.

(10) Patent No.: US 12,687,073 B1
(45) Date of Patent: Jul. 21, 2026

(54) WORK TOOL ALIGNMENT SYSTEM FOR WORK VEHICLE

(71) Applicant: Deere & Company, Moline, IL (US)

(72) Inventors: Brett S. Graham, Dubuque, IA (US); Arun Narayanan, Pune (IN); Abhinav C. Shikhare, Pune (IN); Mark A. Simon, Dubuque, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 19/194,853

(22) Filed: Apr. 30, 2025

(51) Int. Cl.
*E21B 7/00* (2006.01)
*E21B 7/02* (2006.01)

(52) U.S. Cl.
CPC ..... *E21B 7/022* (2013.01); *E21B 7/027* (2013.01)

(58) Field of Classification Search
CPC ..... E21B 7/022; E21B 7/027
See application file for complete search history.

(56) References Cited

U.S. PATENT DOCUMENTS

| | | | |
|---|---|---|---|
| 6,132,163 | A | 10/2000 | Andrews et al. |
| 9,157,201 | B2 | 10/2015 | Fukano et al. |
| 9,476,256 | B2 | 10/2016 | Pursimo et al. |
| 10,975,547 | B2 | 4/2021 | Mahrenholz |
| 11,008,849 | B2 | 5/2021 | Sherlock |
| 11,933,021 | B2 | 3/2024 | Ready-Campbell et al. |
| 2003/0066662 | A1 | 4/2003 | Rynard |
| 2022/0098930 | A1* | 3/2022 | Glover ..... E21B 7/024 |
| 2022/0106880 | A1* | 4/2022 | Willaman ..... E21D 20/003 |
| 2023/0349282 | A1* | 11/2023 | Mcneill ..... E21B 49/003 |

OTHER PUBLICATIONS

DIGGA Drilling Drives For 8-30 Ton Excavators (13 pages)(undated but admitted to be prior art).

* cited by examiner

*Primary Examiner* — Eyamindae C Jallow
(74) *Attorney, Agent, or Firm* — William E. Sekyi; Lucian Wayne Beavers; Patterson Intellectual Property Law, PC

(57) ABSTRACT

A work vehicle having an implement positioning system can include a frame supported above a ground surface by ground engaging units and a work tool pivotally attached to a distal end of a boom assembly. The boom assembly is coupled to the frame to pivot the work tool through an arc between an upper position and a lower position. The work tool rotates an implement about a tool axis which can be inclined relative to a target axis. A controller receives a boom position signal from a boom position sensor which is indicative of an arc position of the distal end and an inclinometer signal from a tool axis sensor which is indicative of a longitudinal inclination and a transverse inclination to the target axis. The controller is configured to display tool axis inclination information on the display and configured to operate the plurality of ground engaging units based on the inclinometer signal or the boom position signal.

15 Claims, 8 Drawing Sheets

WORK TOOL ALIGNMENT SYSTEM FOR WORK VEHICLE

FIELD OF THE DISCLOSURE

The present disclosure generally relates to a system for controlling the position of a work vehicle to maintain alignment of a boring tool mounted on the vehicle's boom as the tool bores a borehole in a ground surface. More specifically, the present disclosure relates to a system for controlling the work vehicle position to maintain alignment of the boom-mounted boring tool that follows an arced path when the boom lowers the tool to drill a borehole in the ground surface.

BACKGROUND

Boring tools, such as powered augers have been attached to the booms of work vehicles, such as skid steer loaders to drill holes into the ground surface for planting in agriculture, settings fence posts, boring drainage shafts etc. Keeping the auger aligned with hole in the ground is important to eliminate oversized holes and to eliminate side loads on the auger which can result in excessive wear or damage to the auger. The wear and damage can require repairs to worn auger bits, auger flights, pipes and hubs, as well as repairs to auger drive shafts, seals and gearboxes. Maintaining the auger alignment along a desired axis during the drilling operation is also important to avoid misaligned or oversized boreholes that are unsuitable for placement of fence posts, trees, or soil stabilization components. Generally, work vehicles with a boring tool mounted to the work vehicle via a free end of a boom raise and lower the work tool using a curved pivoting motion that follows an arced path, not a straight linear path. Therefore, to drill a straight borehole that is aligned with a vertical or other target axis, operators of these work vehicles constantly adjust the position of the work vehicle or the position of boom assembly components to maintain alignment while pivoting the boom to drill the borehole. Operator fatigue, and lack of skill can result in drilling misaligned boreholes. Some systems exist for monitoring a the inclination of the work tool. However, these systems still rely on the operator to manually adjust the position of the work vehicle and boom assembly. Therefore, a need exists to more reliably drill properly aligned boreholes using such work vehicles.

SUMMARY OF THE DISCLOSURE

In one embodiment, a work vehicle having an implement positioning system can include a frame, a plurality ground engaging units configured to support the frame above a ground surface. A boom assembly having a near end and a distal end can be pivotably coupled to the frame at the near end and extend in a boom direction to the distal end. The boom assembly can have a boom position sensor configured to generate a boom position signal indicative of an arc position of the distal end. A work tool can be pivotably attached to the distal end and coupled to the frame via the boom assembly. The work tool is configured to rotate an implement about a tool axis, the tool axis having a longitudinal inclination to a target axis and a transverse inclination to the target axis relative to the boom direction and configured to pivot the work tool through an arc between an upper position and a lower position. The work vehicle also includes a tool axis sensor configured to measure the longitudinal inclination and the transverse inclination of the tool axis, and to generate a corresponding an inclinometer signal in response. In addition, the work vehicle includes a controller operatively coupled to a display and the plurality of ground engaging units and coupled to receive the inclinometer signal and the boom position signal. The controller is configured to display tool axis inclination information on the display and configured to operate the plurality of ground engaging units based on the inclinometer signal or the boom position signal. The target axis can be a vertical axis and the inclinometer signal can include a longitudinal inclination signal and the transverse inclination signal. According to one alternative, the controller is configured to operate the plurality of ground engaging units to align the tool axis with the target axis based on the longitudinal inclination signal and the transverse inclination signal.

Optionally, the work vehicle can also include a receiver mounted on the vehicle, and a memory connected to the controller, wherein the memory is configured to store a target borehole location. The receiver is configured to receive from each of a plurality of remote wireless transmitters a corresponding position signal to determine a current vehicle position based on the received position signals. The controller is communicatively coupled to receive the current vehicle position from the receiver and configured to determine when a separation distance between the target borehole location and the current vehicle location is below a threshold value.

According to another option, the work vehicle can include a boom actuator coupled between the frame and the boom assembly, and actuatable to pivot the boom assembly relative to the frame. The controller is operatively coupled to actuate the boom actuator to pivot the work implement between the upper position and the lower position in response to receiving an operator command.

According to one aspect of this option, the operator command can include the tool length, a target borehole depth, a target axis longitudinal inclination and a target axis transverse inclination. In response to the operator command, the controller can be configured to operate the work tool to rotate the implement, and to actuate the boom actuator until the tool tip reaches the target depth while operating the plurality of ground engaging units to maintain the tool axis aligned with the target axis. The arc position of the distal end can be indicative of a height measurement and a reach measurement, and the work tool can have a tool length which specifies a position of a tool tip relative to the distal end.

In yet another option, the memory can be further configured to store a boundary line having a starting boundary point and an ending boundary point. The controller can be configured to generate a plurality of candidate borehole points based on a desired operator spacing and to display the boundary line, the candidate borehole points, current vehicle location. Additionally, the controller can be configured to receive from an operator interface a command selecting a candidate borehole point as a target borehole location.

According to a further option, the controller can be configured to determine a reach distance of the distal end based on the boom position signal and configured to operate the plurality of ground engaging units based on the reach distance to maintain a target axis longitudinal inclination and a target axis transverse inclination.

According to a still further option, the controller can be configured to additionally operate the plurality of ground engaging units based on the received inclinometer signal to maintain the target axis longitudinal inclination and the target axis transverse inclination.

An alternative embodiment of a work vehicle having an implement alignment system can include a frame supported above a ground surface by a plurality ground engaging units, which are operable to propel and steer work vehicle along the ground surface. A boom assembly having a near end and a distal end can be pivotably coupled to the frame at the near end and extend in a boom direction to the distal end. The boom assembly is configured to pivot the distal end through an arc between an upper position and a lower position. The work vehicle can also include a work tool pivotably attached to the distal end and coupled to the frame via the boom assembly. The work tool is configured to rotate an implement having an implement tip about a tool axis. The work tool has a tool length indicative of the position of the implement tip relative to the distal end, the tool axis having a longitudinal inclination to a vertical axis and a transverse inclination to the vertical axis relative to the boom direction. The work vehicle can also include a tool axis sensor and a boom position sensor. The tool axis sensor can be configured to measure the longitudinal inclination and the transverse inclination of the tool axis, and to generate an inclinometer signal in response. The boom position sensor can be configured to measure a pivot position of the implement tip relative to the frame and to generate an arc position signal in response, wherein the arc position signal is indicative of a reach distance and a height of the implement tip relative to the frame. The work vehicle can further include a controller configured to receive an align command and in response to operate the ground engaging units to align the tool axis with the vertical based on the arc position signal.

According to one aspect of this embodiment, work vehicle can also include a display communicatively coupled to the controller. The controller can be configured to receive the inclinometer signal from the tool axis sensor and to display tool axis inclination information on the display.

Optionally, the work vehicle can include a receiver mounted on the vehicle, and a memory connected to the controller which stores a target borehole location. The receiver can be configured to receive from each of a plurality of remote wireless transmitters a corresponding position signal and to determine a current vehicle position based on the received position signals. The controller is communicatively coupled to receive the current vehicle position from the receiver and to determine when a separation distance between the target borehole location and the current vehicle location is below a threshold value.

According to one aspect of this option, work vehicle can include a boom actuator coupled between the frame and the boom assembly, and actuatable to pivot the boom assembly relative to the frame. The controller can be operatively coupled to actuate the boom actuator to pivot the work implement between the upper position and the lower position in response to receiving an operator bore command which includes the tool length, a target borehole depth. The controller is configured to operate the work tool to rotate the implement. The controller is configured also to actuate the boom actuator until the tool tip reaches the target borehole depth while operating the plurality of ground engaging units to maintain the tool axis aligned with the vertical axis.

According to another aspect of this option, the memory is further configured to store a boundary line having a starting boundary point and an ending boundary point. The controller can be configured to generate a plurality of candidate borehole points based on a desired operator spacing and to display the boundary line, the candidate borehole points, and current vehicle location on the display, and to receive from an operator interface a command selecting a candidate borehole point as a target location.

As a further option, in response to the align command the controller can be configured to operate the ground engaging units to align the tool axis with the vertical axis based on the inclinometer signal and the arc position signal.

DETAILED DESCRIPTION

Figure 1:
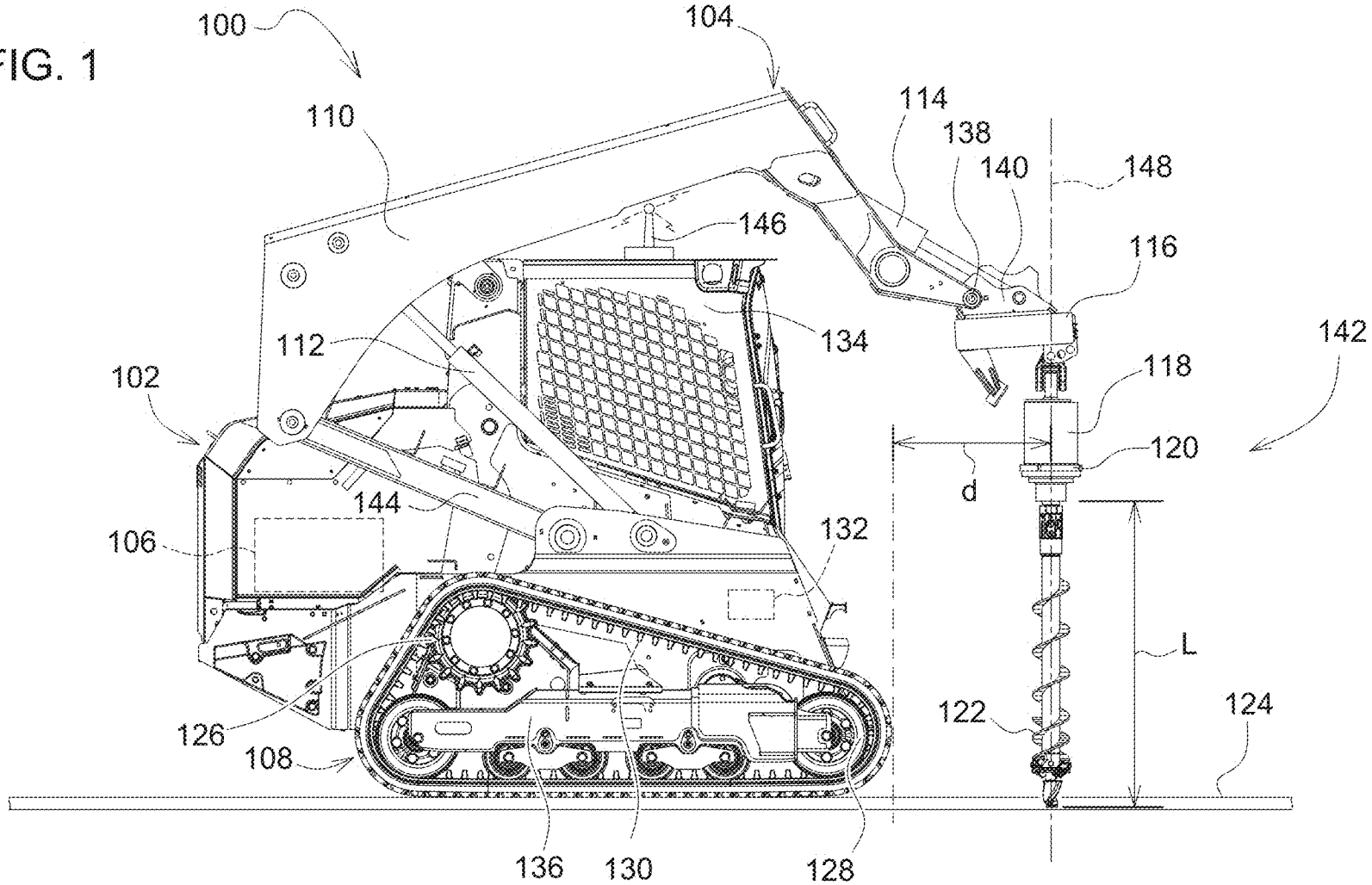
FIG. 1 is a left side view of an exemplary work vehicle which is a skid steer loader, with drive wheels and a bucket.

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

One embodiment of the present disclosure is a system for controlling the position of a work vehicle to maintain alignment of a boom-mounted work tool, which can be an implement such as boring tool. The boom and attached boring tool follow an arced path as the boom pivots to lower the tool to bore or drill a borehole in a ground surface, and the control system adjusts the position of the work vehicle so that the boring tool remains aligned with the desired axis of the borehole during this process. Referring to FIGS. 1-8, an exemplary embodiment of a work vehicle 100, can be a compact track skid steer loader, as shown. However, the present embodiment is applicable to several other types of work vehicle that can be uses a boom to raise and lower a boring tool along a curved or arced path, such as backhoe loaders, excavators, wheel loaders, and telehandlers.

Work vehicle 100 can include a structural member, such as frame 102, which to which components and mechanisms of work vehicle 100 can be fixedly attached. Work vehicle 100 can include a cab 134 with an operator interface connected to controller 132. The operator can use the operator interface to receive information from controller 132 about the operation of work vehicle 100 and input commands transmitted to controller to operate work vehicle 100. A power unit 106, which can be an internal combustion engine, a battery pack that powers electric motors and actuators, or other power unit for producing mechanical, electrical, or hydraulic power to drive the work vehicle's components and devices, can be mounted on the frame 102.

One or more ground engaging units 108 on each side of work vehicle 100 can be coupled to frame 102 to support frame 102 above ground surface 124 and also to propel and steer work vehicle 100 along the ground surface 124. Ground engaging units 108 can include wheels or track undercarriages. FIG. 1 shows a work vehicle 100 which is a compact track skid steer loader with a ground engaging unit that is a track undercarriage on each side of frame 102. Each track undercarriage includes a crawler track 130 which surrounds a drive sprocket 126, idler wheels and rollers 128, and undercarriage subframe 136. Sprocket 126 engages track 130 and is attached to a sprocket drive motor mounted on frame 102 which is powered to rotate sprocket 126 and drive track 130.

Controller 132 can be configured with programming code, and data stored in an associated memory to receive commands to operate the features and components of the work vehicle 100. The controller 132 can receive commands from the operator interface in the cab, from a remote operator interface via one or more receivers 146 that receive wireless signals from a remote transmitter, or from commands stored in memory which the controller 132 can execute to operate work vehicle 100 autonomously. One of the receivers 146 can also be designed to receive position signals wirelessly from remote transmitters. A position signal received from a remote wireless transmitter can include, for example, information regarding the position of the transmitter and its distance from the receiver's antenna. The receiver 146 can receive position signals from multiple remote wireless transmitters and use the information in each position signal received from the multiple transmitters to determine the location (such as geographical coordinates) of the receiver's antenna and, thus, the work vehicle 100. For example, one known technique used in Global Positioning Systems ("GPS") to calculate location, velocity and elevation of a receiving antenna is called trilateration. In response to receiving a position signal, signal receiver 146 can transmit a location signal to the controller 132 which can use the position information to determine a current vehicle location of work vehicle 100. Controller 132 can use the current vehicle location for navigational guidance of the work vehicle 100, and to retrieve information regarding the local environment surrounding the work vehicle 100.

An operator can manipulate an operator interface, which can include operator input devices such as joysticks, pedals, levers, and/or switches, to operate work vehicle 100 and propel frame 102 along the ground surface 124. Additionally, the operator can manipulate input devices to drive the ground engaging units 108 on the right and left side of frame 102 at different speeds to steer the work vehicle 100 in a conventional skid steer fashion. For example, by driving left sprocket 126 (and consequently left track 130) forwards slower, or backwards, relative to right sprocket 126 and track 130, the operator can steer the vehicle 100 to the left when driving forwards, or rotate it counterclockwise as viewed from above. Conversely, by driving right sprocket 126 and track 130 forwards slower or backwards relative to left sprocket 126 and track 130, the operator can steer the vehicle 100 to the right when driving forwards, or rotate it clockwise as viewed from above.

Work vehicle 100 also includes a powered work tool 142 for boring or drilling boreholes in ground surface 124. Such tools can include drills or augers, for example. In the embodiment shown in FIGS. 1 and 3, work tool 142 is a hydraulically powered auger, pivotably coupled to frame 102 via a boom assembly 104. Boom assembly 104 includes a pair of boom arms 110 (more clearly visible in FIG. 3), boom linkage 144, and coupler receiver 140. At a near end of boom assembly 104, boom linkage 144 couples boom arms 110 to pivot in a boom direction 304 relative to frame 102. Boom cylinders 112 is coupled between frame 102 and each of the two boom arms 110. Boom cylinders 112 include pistons which extend to pivot boom arms 110 to an upper position and retract to pivot boom arms down to their lower positions. Each boom cylinder 112 can include a boom position sensor 222, such as a magnetostrictive sensor, that measures the extension of the boom piston. Alternatively, boom position sensor can be a rotation angle position sensor which is positioned to measure the angle of boom cylinder 112, or a linkage in the boom assembly 104 (such as boom linkage 144), relative to machine frame 102. Coupler receiver 140 can be coupled at a distal end of boom assembly 104 by distal end pins 138 to pivot relative to the ends of each boom arm 110. Coupler receiver 140 can be configured to couple work tool 142 to work vehicle 100 so that the work tool is mechanically attached to boom assembly 104, as well as hydraulically, electrically, and/or communicatively coupled, as applicable, for the work tool. Tilt hydraulic cylinder 114 is coupled between each boom arm 110 and coupler receiver 140 to control the tilted orientation of the coupler receiver 140 and base housing 116 of work tool 142 which is attached to coupler receiver 140. Each tilt cylinder 114 includes a piston which can extend to pivot coupler receiver 140 forwards or retracted to pivot coupler receiver 140 backwards. Similar to boom position sensor 222, a tilt position sensor 224 can be integrated with one or more tilt cylinders 114 to measure the extension of the tilt cylinder piston, or can be located at distal end pins 138 or between linkages to measure the angle between coupler receiver 140 and boom arm 110.

Figure 3:
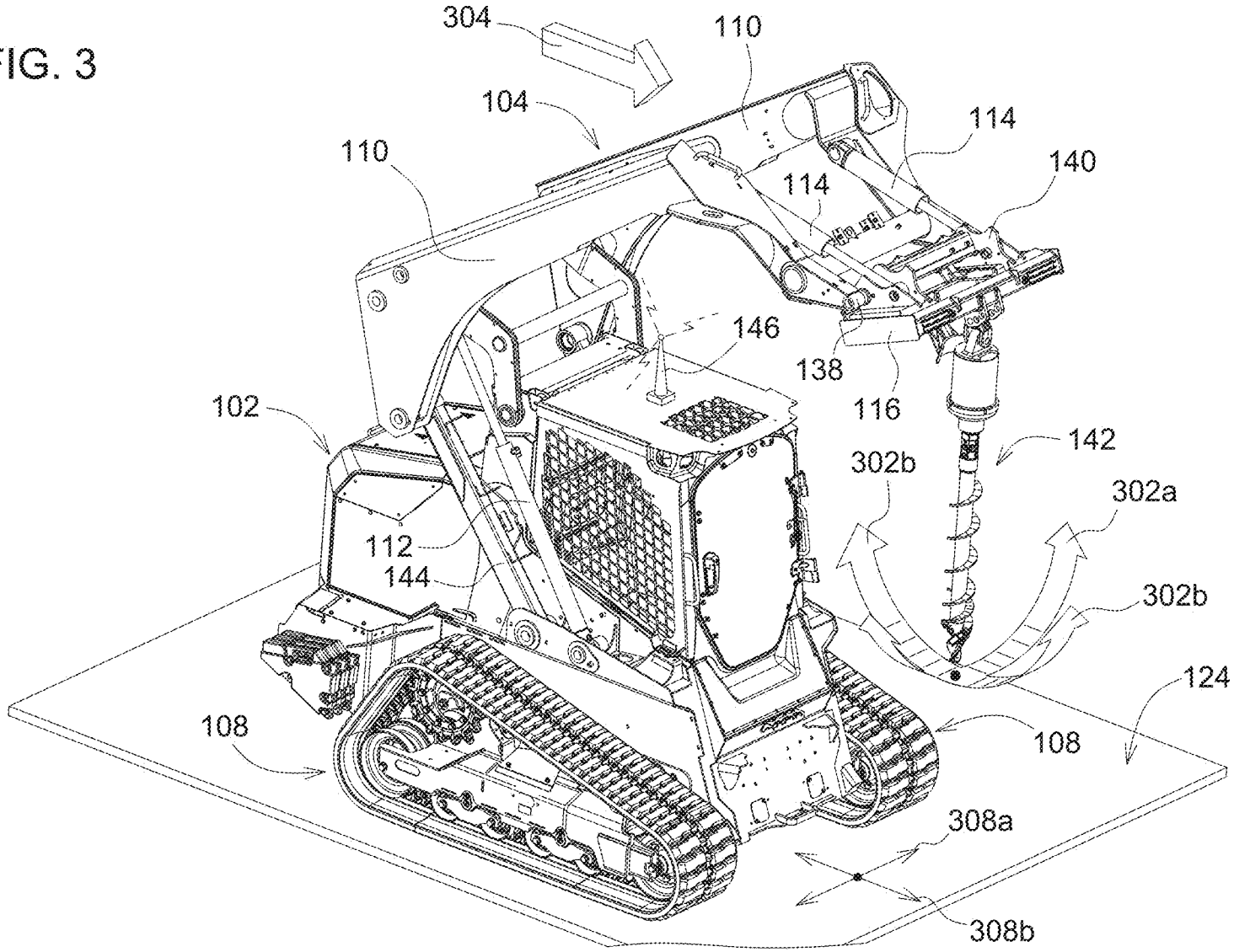
FIG. 3 is perspective isometric view schematic of the exemplary work vehicle with a raised work tool.

Although work tool 142 of FIGS. 1 and 3 is a hydraulically powered auger, skilled artisans will appreciate that electrically or mechanically powered augers may also be suitable work tools. In addition to providing a mounting bracket to mechanically attach and support base housing 116, coupler receiver 140 can include hydraulic fluid couplers to connect the work vehicle's hydraulic system to valves, actuators, and hydraulic motors in work tool 142. Coupler receiver 140 can also include electrical connectors to connect the work vehicle's controller 132 and communication lines to sensors and control circuits in work tool 142 via base housing 116. Work tool 142 also includes a drive assembly 118. Drive assembly 118 can include a hydraulic auger motor, transmission, and control valves which control the flow of hydraulic fluid received from and returned to the work machine's hydraulic system to operate the auger motor. In operation, auger motor can drive a drive assembly output shaft via a transmission to rotate auger 122, which is attached to the output shaft as a component of work tool 142, about a rotational axis or tool axis 148. The auger 122 has a length L from the bottom of drive assembly 118 to the auger's tip. As shown in FIG. 3, drive assembly 118 can be connected to base housing 116 by a two-way hinged coupling so that drive assembly 118 and auger 122 can pivot in a longitudinal direction **302*b* and in a transverse direction 302*a* relative to the boom direction 304. However, the hinged coupling rotatably fixes drive assembly 118 to base housing 116. Because the attachment position of the hinged coupling is fixed on based housing 116, and the distance between the tip of auger and hinged coupling is known from the drive assembly dimensions and auger length L, the position of the auger tip can be determined relative to distal end pins 138 by considering signals from boom position sensor 222, tilt position sensor 224 and the inclination of the work tool. Drive assembly 118 can also include inertial measurement unit sensors such as a work tool inclinometer 120 that measures the angle of inclination of tool axis 148 relative to a reference, such as gravitational vertical, and a rotational speed sensor to measure the rotational speed of auger 122** and generate an inclinometer signal that is responsive to the work tool's measured angle of inclination.

Figure 2:
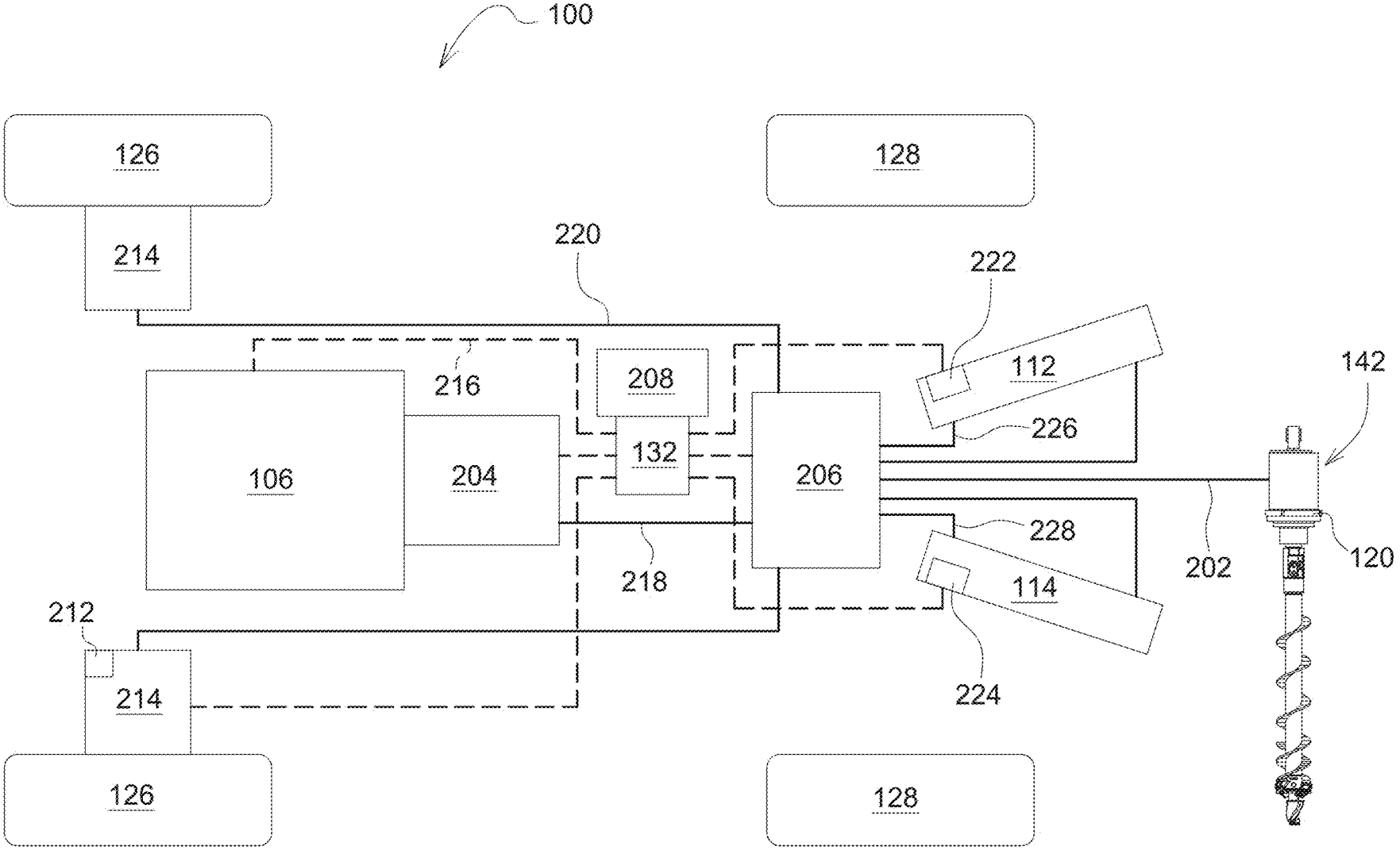
FIG. 2 is a schematic view of mechanical, hydraulic, and control systems of an exemplary work machine.

FIG. 2 is a schematic diagram of one embodiment of work vehicle 100 showing how its mechanical, hydraulic, and control systems can be interconnected. In FIG. 2, the work vehicle 100 includes power unit 106 (an internal combustion engine) coupled to drive a hydraulic pump 204. Optionally, power unit 106 can be coupled to multiple pumps adapted to drive different work machine hydraulic systems. Hydraulic pump 204 can be a variable displacement hydraulic pump which can be controlled to vary its displacement to adjust the flow rate of hydraulic fluid it pumps for a given engine drive speed. Hydraulic fluid pumped from an output of hydraulic pump 204 flows through input hydraulic line 218 to an input of valve block 206. Valve block 206 can include electrohydraulic solenoid valves which can be selectively opened or closed, as well as electrohydraulic variable flow proportional solenoid valves which each can controlled to vary the flow rate of hydraulic fluid passing through the valve. Controller 132 can actuate the electrohydraulic valves to permit the flow of hydraulic fluid from the input of valve block 206 to output hydraulic lines 202 connected to auger motor, output hydraulic lines 220 connected to sprocket motors 214, and output hydraulic lines 226, 228 connected at output ports of valve block 206. Thus, controller 132 can selectively start and stop actuation of a connected hydraulic device, such as a motor or actuator, by opening or closing electrohydraulic solenoid valves. Alternatively, controller 132 can adjust the flow rate of hydraulic fluid through a electrohydraulic variable flow proportional solenoid valve to control the speed with which connected hydraulic devices actuate.

Output hydraulic lines 220 can connect the output ports to left and right side sprocket drive motors 214, to hydraulic boom cylinder 112 and tilt cylinder 114. Output hydraulic lines 202 can connect output ports to auger hydraulic motor in work tool 142. Work vehicle 100 also includes a communication network, shown in dashed lines, with communication lines 216 that transmit control and data signals between control circuits and sensors in components and devices of work vehicle 100 and controller 132. Thus, communication lines 216 operatively couple controller 132 to control the operation of power unit 106, hydraulic pump 204, valve block 206, work tool 142 and, as a further option, sprocket drive motors 214. Controller 132 can further indirectly operate boom and tilt cylinders 112, 114, work tool 142 and sprocket drive motors 214 by controlling the flow of hydraulic fluid into valve block 206 through hydraulic line 218, and by controlling the flow of hydraulic fluid from valve block 206 to the actuators and motors through hydraulic lines 220, 202.

In addition to work tool inclinometer 120, sensors and control circuits in components and devices that communication lines 216 connect to controller 132 can include engine speed and torque/power sensors and controllers, odometer and/or speed sensor 212 in one or more sprocket drive motors 214. Optionally, controller 132 can be connected through communication lines 216 to receive signals from additional inertial measurement unit sensors attached to frame 102, such as a frame inclinometer, that measures the inclination of frame 102 relative to a local gravitational vertical. An inertial measurement unit can also be attached to other work machine components to provide information regarding the orientation and position of frame 102. Communication lines 216 can also connect controller 132 to hydraulic displacement control circuits and hydraulic pressure sensors in hydraulic pump 204, and to a boom position sensor 222 and tilt position sensor 224 in boom hydraulic cylinder 112 and in tilt hydraulic cylinder 114, respectively. Controller 132 can also be communicatively coupled to receive operator commands from operator interface 208, as well as location signals and remote operator commands from receiver 146. In addition, controller 132 can be configured to retrieve and execute commands and data stored in its associated memory. Boom position sensor 222 and tilt position sensor 224 generate, respectively, a boom position signal indicative of the position of the distal end pins 138 relative to frame 102 and a tilt position signal indicative of the position of base housing 116 relative to distal end pins 138. These signals are indicative in that they represent measurements that can be used to calculate or determine operating variables of work machine 100. Controller 132 can be configured to receive these inertial measurement unit signals and position sensor signals to determine the position of distal end pins 138 (including the height above ground surface 124 and reach distance), and the position of auger tip 402 (using the work tool information stored in memory and inclination information). Being at least one of the measurements controller 132 can use to determine the position of the distal end pins 138 and position of auger tip 402, each of these inertial measurement unit signals and position sensor signals is indicative of the arc position of auger tip 402.

Operator interface 208 can include one or more hand controls or joysticks, foot controls or foot pedals, display screens, and consoles with buttons, switches, dials, or levers. Using operator interface 208 an operator can input commands to control the operation of the work vehicle 100. An operator can also receive information relating to the operating state of the work machine through operator interface 208 which can include a display, dials, and indicators. Based on operator commands and data controller 132 receives, controller 132 can be configured to transmit control signals to control the operation of power unit 106, hydraulic pump 204, valve block 206, sprocket drive motors 214, and work tool 142. Thus, controller 132 can regulate the operation of work tool 142, actuate boom and tilt cylinders 112, 114 to lower and raise work tool 142 to drill a borehole in ground surface 124, and to propel work vehicle 100 in a backwards and forwards in a longitudinal direction 308*b* or left and right in a transverse direction 308*a* relative to boom direction 304.

Figure 4:
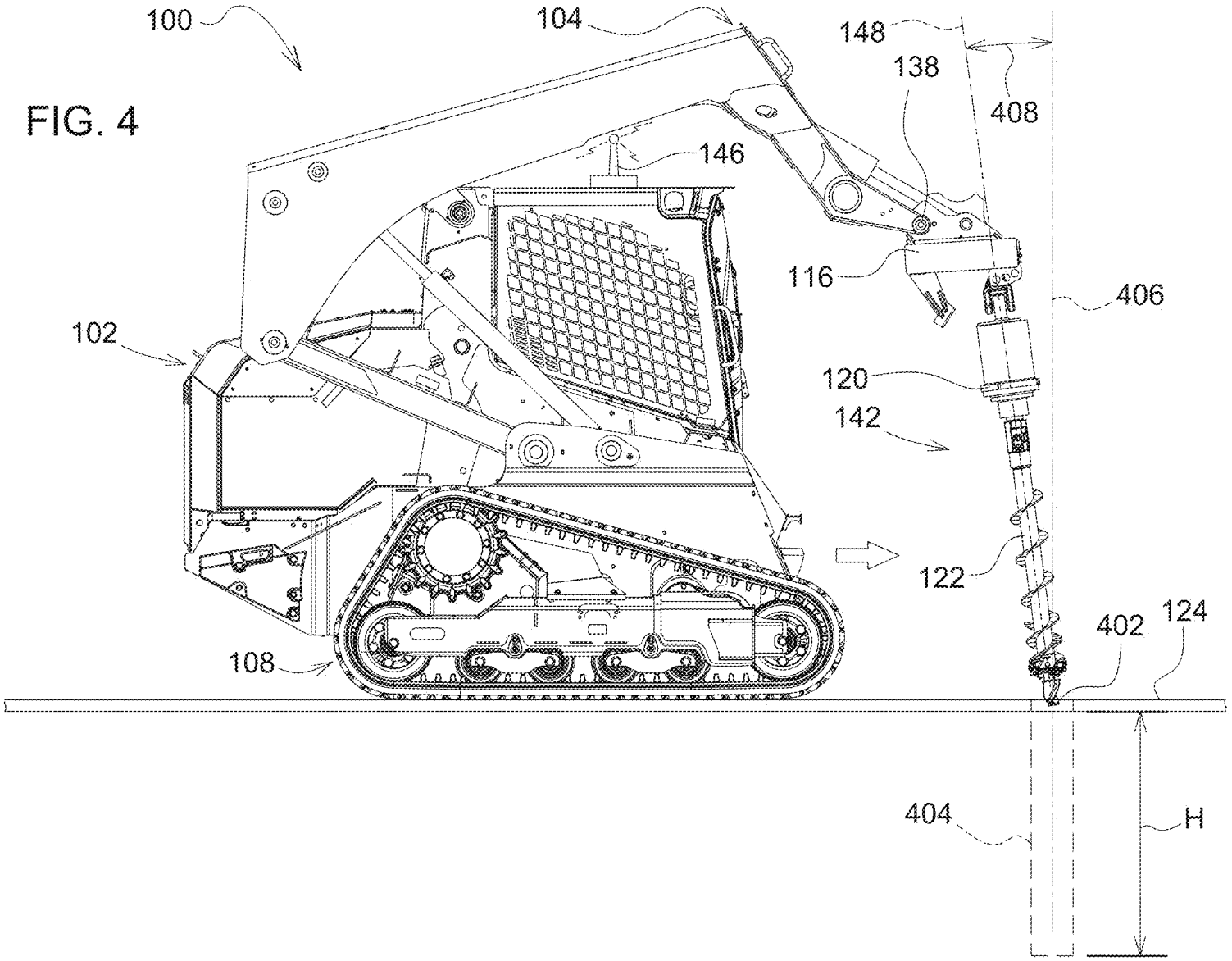
FIG. 4 is a side view of the exemplary work vehicle with the work tool touching the ground surface and inclined to a vertical axis.

As shown in FIG. 4, controller 132 can lower boom assembly 104 so that the tip 402 of auger 122 contacts ground surface to begin boring a borehole 404 having borehole central axis 406 and depth H. In this example, borehole central axis 406 is aligned with the local gravitational vertical as could be determined with a plumb line. However, in other examples, borehole central axis can be any desired inclination relative to the vertical for boring a borehole in ground surface 124. Drive assembly 118 and its auger 122 have pivoted on base housing 116 so that the auger's rotational axis or the tool axis 148 is inclined at inclination angle 408 in the longitudinal direction 302*b* and at some inclination angle in the transverse direction 302*a*. Controller 132 can receive an inclinometer signal from work tool inclinometer 120 which can include a longitudinal inclination signal indicative of the longitudinal inclination of the tool axis to the vertical and a transverse inclination signal indicative of the transverse inclination of the tool axis to the vertical.

Figure 7:
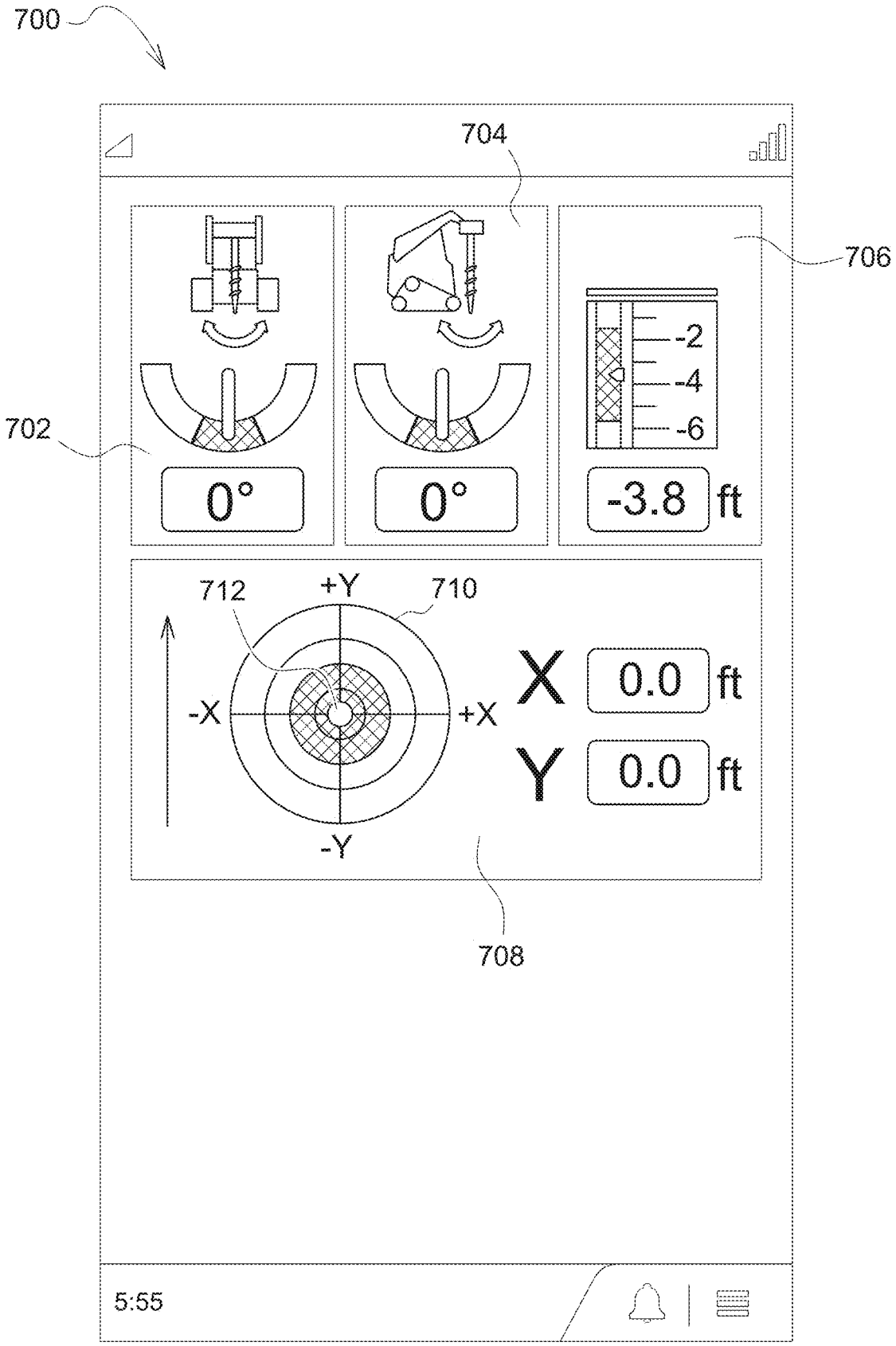
FIG. 7 is an operator interface display showing work tool inclination and depth information.

As shown in FIG. 7, controller 132 can display information regarding the inclination of work tool 142, relative to an external reference, such as gravitational vertical, or relative to the inclination of frame 102, on a display 700 in operator interface 208. The memory associated with controller 132 can store information regarding the dimensions of work tool 142, dimensions of base housing 116, drive assembly 118 and auger length L. Controller 132 can retrieve this information and combine it with tilt position measurements from tilt position sensor 224 as well as longitudinal and transverse inclination measurements from work tool inclinometer 120 and frame inclinometer to determine the tip position 712 of auger tip 402 on the bullseye display 710 of tip position display 708. Controller 132 can also display longitudinal and transverse inclination measurements in the longitudinal inclination display 704 and transverse inclination display 702, respectively. Additionally, depth display 706 can display the depth of auger tip 402 below (or height above) ground surface 124. Optionally, an operator can use the inclination information to adjust the inclination of the work tool 142 to align with a with the central axis 406 of borehole 404 in ground surface 124. Thus, the tool axis 148 should be aligned with a target axis which, in this example, is the central axis 406 of borehole 404 to be bored, which is vertical. Accordingly, using this information, an operator can manually propel and steer work vehicle 100 (for example by driving forward as indicated by the arrow on FIG. 4) to adjust position of work vehicle 100 until tool axis 148 is aligned with the target axis, which is borehole central axis 406. With auger tip 402 just touching ground surface 124 at the planned borehole position, and tool axis 148 aligned with borehole central axis 406, the operator can issue an initialization command through operator interface 208 to set the inclination of the target axis, borehole coordinates, and surface level for auger tip 402. With initialization complete, controller 132 can adjust display 700 to reflect the initialization information stored in memory or received from the operator. For example, the depth display can reset the surface level to reflect the level of the ground surface 124 measured by auger tip 402, and the bullseye display 710 can be adjusted to that its center coincides with the inclination of auger tip 402 when aligned with the target axis and so the longitudinal and transverse inclinations are measured relative to the target axis.

Figure 5:
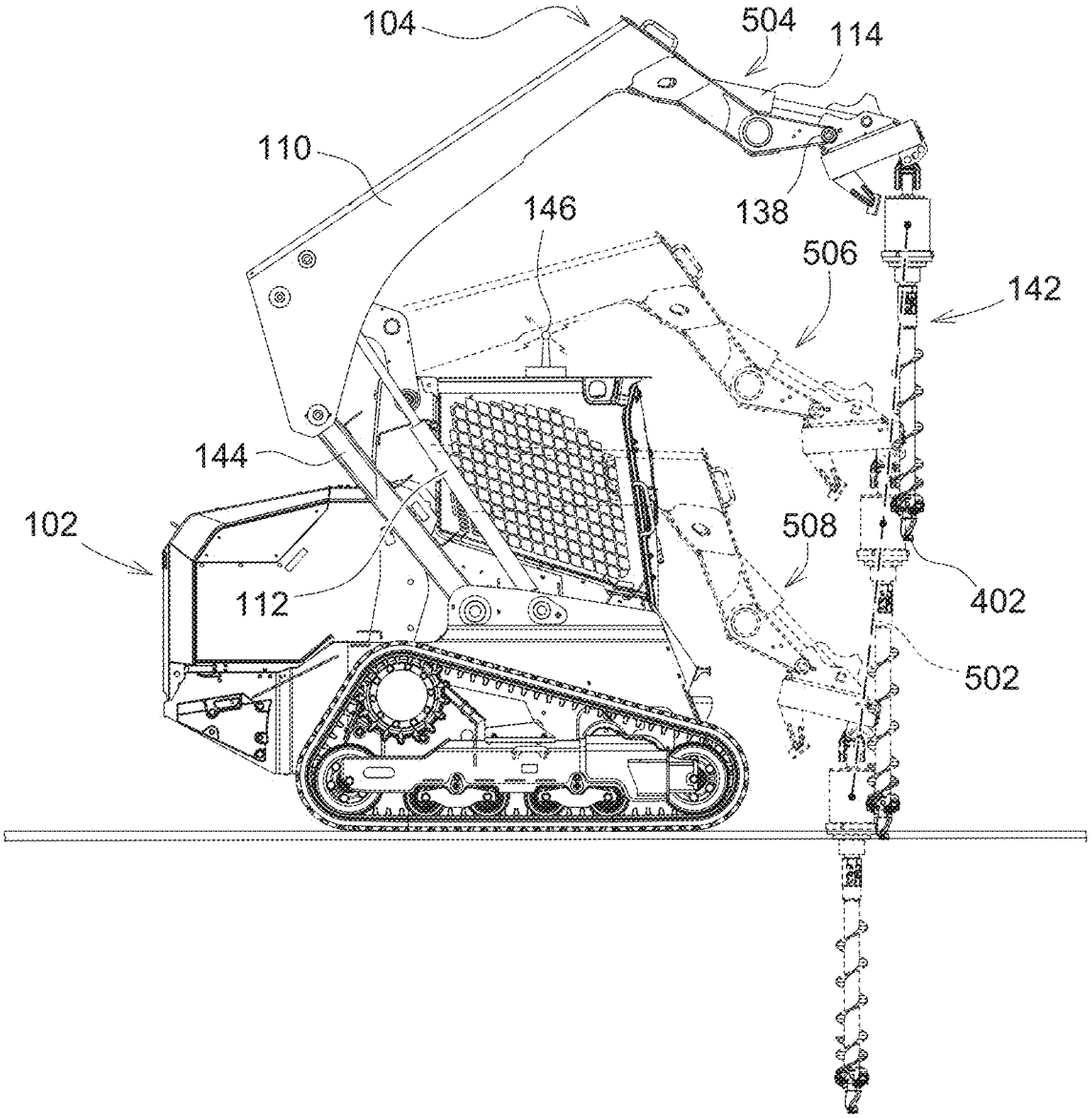
FIG. 5 is a side view of the exemplary work vehicle showing the arced path of the work tool as the work vehicle pivots the work tool between raised and lowered positions.

As shown in FIG. 5, actuating boom cylinder 112 to extend its piston pivots boom linkage 144 and boom arm 110 relative to frame 102 to raise boom assembly 104 from its lowest position 508 through intermediate position 506 to highest position 504. Retracting boom cylinders 112 pivot the boom assembly downwards from its highest 504 to its lowest position 508, in which position auger 122 of work tool 142 will extend below ground surface 124. Distal end pins 138 represent points at the distal end of boom assembly 104 and trace a curved arc as the boom assembly 104 pivots up or down. Thus, providing extension of tilt cylinder 114 is held constant as boom assembly 104 pivots, work tool 142 follows a similar curved arc 502. With work tool 142 following arc 502, reach distance d (shown in FIG. 1), which is the distance between ground engaging units 108 and the tool axis 148, varies as boom assembly 104 pivots up or down. Reach distance can also vary by the inclination of frame 102 relative to tool axis 406. Accordingly, to bore or drill a borehole in ground surface 124 at a constant inclination needed to bore a straight borehole, work vehicle 100 adjusts its ground position relative to the position of the tool axis 148, and its inclination relative to the inclination of frame 102, to account for the changing reach distance d of tool axis 148 as distal end pins 138 pivot up or down following arc 502. The reach distance and height of distal end pins 138 or of auger tip 402 together represent, respectively, the arc position of distal end pins 138 or the arc position of auger tip 402.

Figure 6:
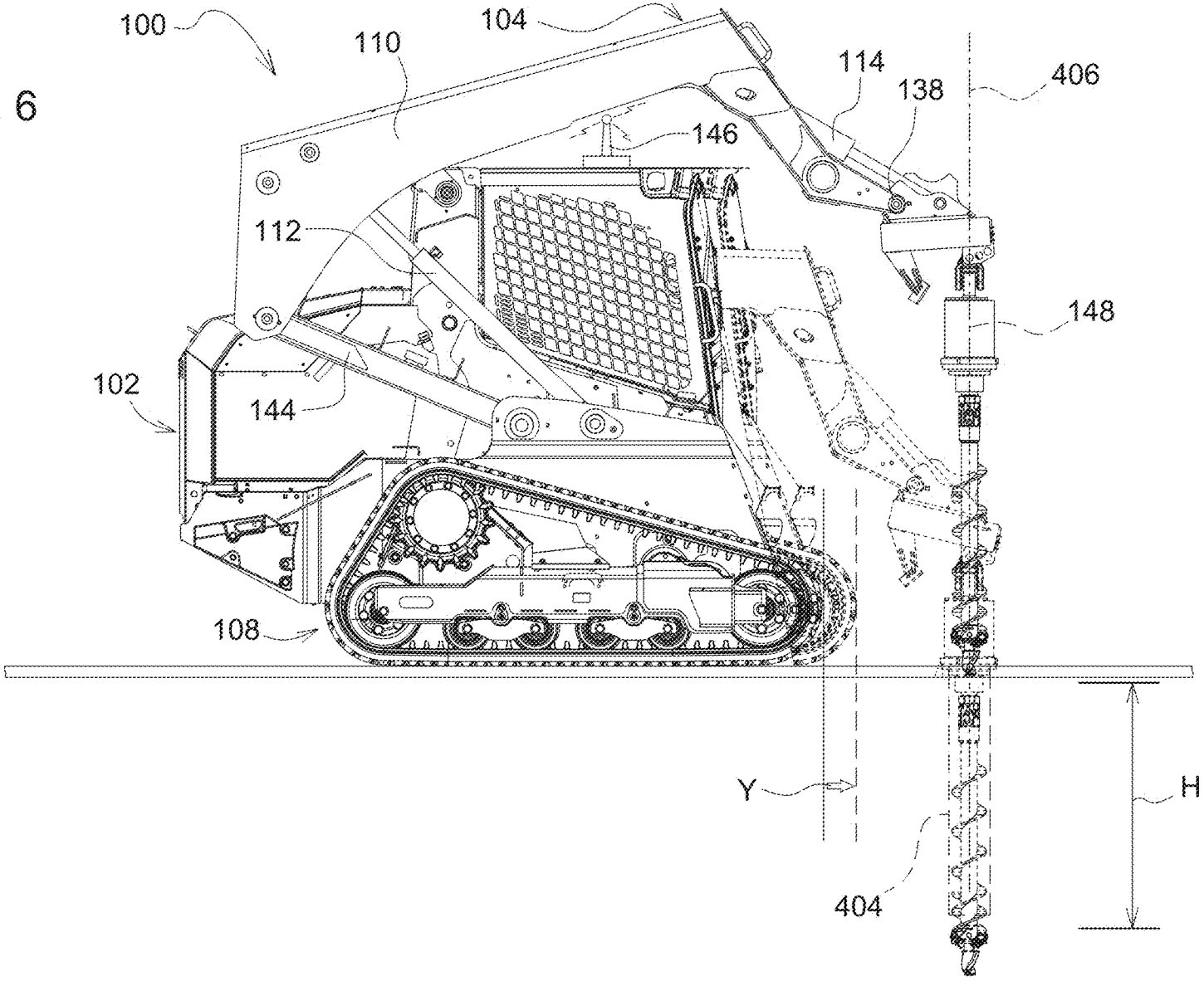
FIG. 6 is a side view of the exemplary work vehicle showing the motion of the work vehicle as it lowers the work tool to maintain the tool axis vertical.

As shown in FIG. 6, at some intermediate position 506, auger tip 402 touches the ground surface with tool axis 148 aligned with borehole central axis 406. In response to an initialization command received from operator interface 208, controller 132 can store in memory inclination information for the target axis for borehole 404, which is aligned with borehole central axis 406. Controller 132 can also store boom and tilt position measurements as well as position information (geographical coordinates) and surface level reference measurement corresponding to the position of auger tip 402 and tool axis at this time. Controller 132 can also retrieve or associate information regarding work tool 142, such as the length of auger 122 and dimensions of drive assembly 118 and base housing 116 with the initialization settings. Once initialized, controller 132 can receive drill command to power the auger motor and rotate auger 122. The operator can then manually operate boom cylinder 112, tilt cylinder 114, propel and steer functions of work vehicle 100 by manipulating the input devices to lower work tool 142 and bore borehole 404 while maintaining tool axis 148 aligned with the target axis using display 700.

Alternatively, controller 132 can be configured to receive a manual or automatic bore command. In response to the manual bore command, controller 132 powers the auger motor to rotate auger 122. In addition, controller 132 uses the received initialization information and current sensor signals to adjust the longitudinal position of work vehicle 100 on ground surface 124 as the operator manually lowers boom assembly 104 to bore borehole 404 towards its target depth H. As operator pivots boom assembly to lower auger 122 into the ground surface 124, controller 132 operates ground engaging units 108 to propel work vehicle 100 in the boom direction 304 to compensate for the changing reach distance d of work tool 142 and distal end pins 138 based on the controller's reach distance determination using boom position signal and tilt position signal. As shown in FIG. 6, as boom assembly 104 is lowered from its intermediate position with auger tip 402 in line with ground surface 124, to bottom of borehole 404, work machine moves distance Y to keep tool axis 148 aligned with borehole central axis 406 as the reach distance becomes smaller. Thus, controller 132 can be configured to operate sprocket drive motors 214 based on its determination of the reach distance of tool axis 148 from boom position signal and tilt position signals to maintain alignment of tool axis 148 with the target axis. During this process, controller 132 can continue to receive operator commands through operator interface 208 to adjust the work vehicle's travel in the longitudinal or transverse directions 308*a*, 308*b*. Such corrections can be necessary if auger 122 encounters rocks or obstructions which force the auger to deviate from the target axis as it penetrates the subsurface or if additional adjustments are necessary due to the unusual geometry of the borehole. As a further option, controller 132 can be configured to use work tool inclinometer 120 and frame inclinometer to automatically make additional fine adjustments to the work vehicle's travel in the longitudinal or transverse directions 308*a*, 308*b* to maintain tool axis 148 aligned with the target axis. With controller 132 operating ground engaging units 108 to maintain alignment of tool axis 148, the operator can focus on operating boom and tilt cylinders 112,114.

Alternatively, on receiving an automatic bore command, controller 132 can be configured to control actuation of boom cylinder 112 and tilt cylinder 114 as well as propelling and steering the ground engaging units 108 to drill a borehole along a target axis to a target depth. To do this, controller 132 can be configured to include in executing the automatic bore command receiving the target borehole depth H from operator interface 208 or memory, in addition to the information controller 132 gathers in response to a manual bore command. Using this information, controller 132 can be configured to determine the depth of auger tip 402 and to operate the auger motor as well las boom and tilt cylinders 112, 114 to drill downwards with work tool 142 until auger tip 402 reaches the target borehole depth H. Optionally, controller 132 can also be configured to receive a command setting the target axis inclination which can be different than the inclination of tool axis 148 during initialization. The target axis inclination can include a target axis longitudinal inclination and a target axis transverse inclination. Using this information, controller 132 can be configured to adjust the inclination of tool axis 148 to drill a borehole of different inclination after initialization, while auger tip 402 is still at surface level and auger 122 has not yet penetrated ground surface 124. As a further option, controller 132 can be configured to receive the location information (such as geographical coordinates) for borehole 404 which can be different from the location of auger tip 402 at initialization. Using this information, controller 132 can be configured to operate boom assembly 104 and ground engaging units 108 to reposition auger tip 402 at a new hole location on the ground surface after initialization. Thus, with this additional information, after initialization controller 132 can use geographical coordinates received through operator interface 208 or stored in memory to locate the precise location of planned boreholes. Also with this additional information, controller 132 can control work vehicle 100 to place auger tip 402 on the ground surface 124 at a target borehole location, align tool axis 148 with the target axis for the borehole 404 and bore a hole down to the borehole's target depth H.

Figure 8:
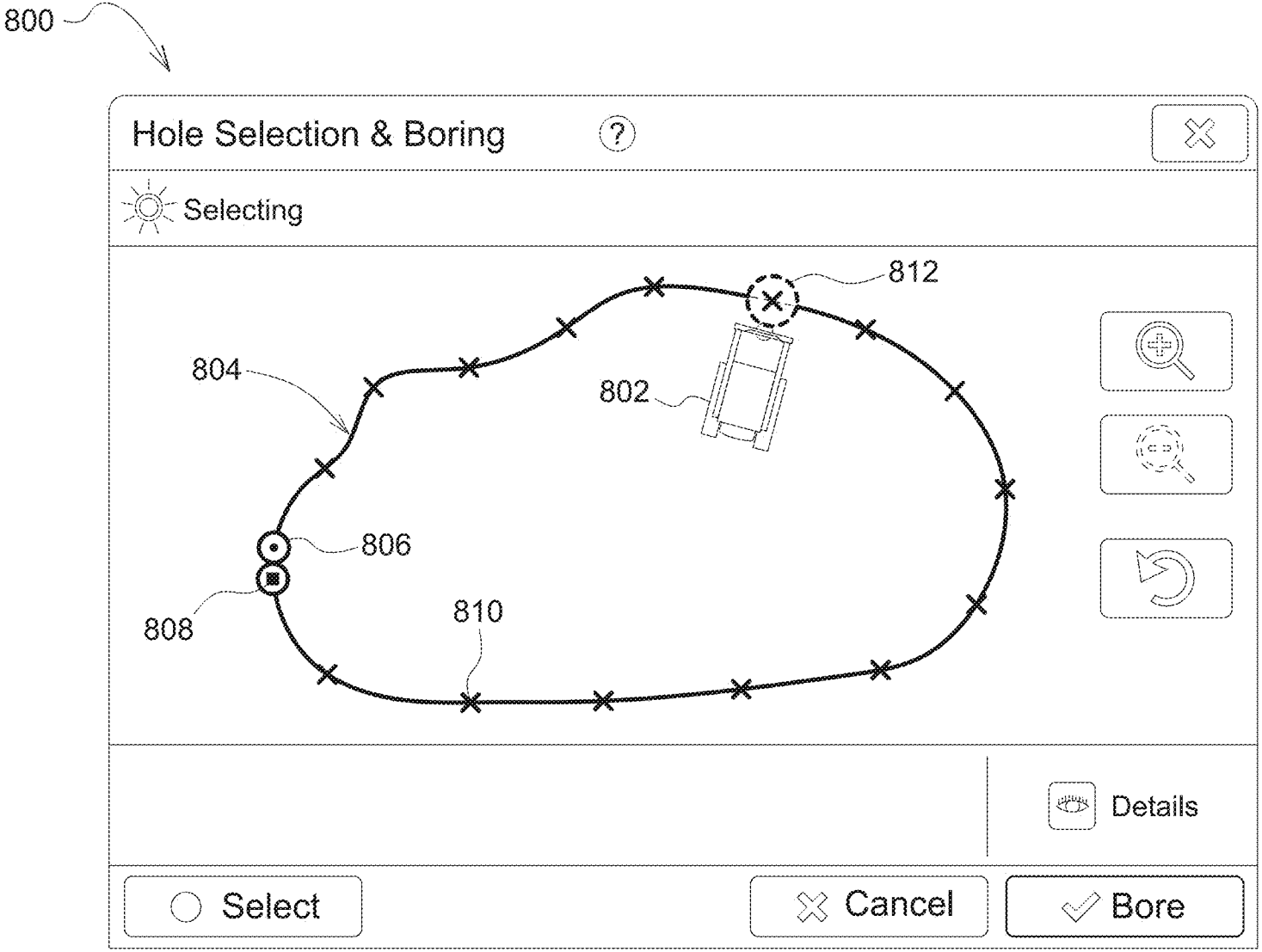
FIG. 8 is an operator interface display showing placement of candidate bore hole locations along a boundary line and a selected target borehole location.

Controller 132 can be configured to store in memory a boundary line 804 along which to drill a series of boreholes and to display boundary line 804 on a display 800 connected to controller 132, as well as the current vehicle location 802 of work vehicle 100, as shown in FIG. 8. Boundary line can have a starting boundary point 806 and ending boundary point 808. Controller 132 can be configured to receive a planned borehole spacing from operator interface 208 or retrieved from a parameter stored in memory. The planned borehole spacing can be specified by a distance between boreholes or the number of boreholes between starting point 806 and end point 808. Based on the planned borehole spacing, controller 132 can be configured to mark on the display the positions of candidate borehole points 810 along boundary line 804. For each candidate borehole point 810, operator can input the inclination of borehole central axis 406 and borehole depth H through operator interface 208 or can command controller 132 to retrieve this information from memory. Using a select command, the operator can select one or more candidate borehole points 810 as target borehole locations 812. Controller 132 can further be configured to determine when work vehicle 100 approaches a target borehole location 812 so that the separation distance between auger 122 and target borehole location 812 is within a threshold value and is therefore nearby. Controller 132 can conveniently alert the operator that target borehole location 812 is nearby by changing its display color, line type, or similar. Operator can issue an initialization command while target borehole location 812 is nearby and subsequently issue an automatic bore command. On receiving the automatic bore command, controller 132 can reposition auger tip 402 on ground surface 124 at the precise geographic coordinates for the target borehole location, set borehole central axis 406 as the target axis, align tool axis 148 with the target axis, and bore the borehole until auger tip 402 reaches target depth H.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A work vehicle having an implement positioning system, the work vehicle comprising:

a frame;

a plurality ground engaging units configured to support the frame above a ground surface;

a boom assembly having a near end and a distal end, the boom assembly pivotably coupled to the frame at the near end and extending in a boom direction to the distal end, and having a boom position sensor configured to generate a boom position signal indicative of an arc position of the distal end;

a work tool pivotably attached to the distal end and coupled to the frame via the boom assembly, the work tool configured to rotate an implement about a tool axis, the tool axis having a longitudinal inclination to a target axis and a transverse inclination to the target axis relative to the boom direction, wherein the boom assembly is configured to pivot the work tool through an arc between an upper position and a lower position; and a tool axis sensor configured to measure the longitudinal inclination and the transverse inclination of the tool axis, and to generate a corresponding an inclinometer signal in response;

a controller operatively coupled to a display and the plurality of ground engaging units and coupled to receive the inclinometer signal and the boom position signal, wherein the controller is configured to display tool axis inclination information on the display and configured to operate the plurality of ground engaging units at least in part in response to the inclinometer signal or the boom position signal.

2. The work vehicle of claim 1, wherein the target axis is a vertical axis.

3. The work vehicle of claim 1, wherein the inclinometer signal includes a longitudinal inclination signal and the transverse inclination signal and wherein the controller is configured to operate the plurality of ground engaging units to align the tool axis with the target axis based on the longitudinal inclination signal and the transverse inclination signal.

4. The work vehicle of claim 3, further comprising a receiver mounted on the vehicle, and a memory connected to the controller, the memory configured to store a target borehole location, wherein the receiver is configured to receive from each of a plurality of remote wireless transmitters a corresponding position signal, wherein the receiver is configured to determine a current vehicle position based on the received position signals, and wherein the controller is communicatively coupled to receive the current vehicle position from the receiver and configured to determine when a separation distance between the target borehole location and the current vehicle location is below a threshold value.

5. The work vehicle of claim 4, further comprising a boom actuator coupled between the frame and the boom assembly, and actuatable to pivot the boom assembly relative to the frame, wherein the controller is operatively coupled to actuate the boom actuator to pivot the work implement between the upper position and the lower position in response to receiving an operator command.

6. The work vehicle of claim 5, wherein the arc position of the distal end being indicative of a height measurement and a reach measurement, wherein the work tool has a tool length which specifies a position of a tool tip relative to the distal end, wherein the operator command includes the tool length, a target borehole depth, a target axis longitudinal inclination and a target axis transverse inclination, wherein the controller is configured to operate the work tool to rotate the implement, and wherein the controller is configured to actuate the boom actuator until the tool tip reaches the target depth while operating the plurality of ground engaging units to maintain the tool axis aligned with the target axis.

7. The work vehicle of claim 4, wherein the memory is further configured to store a boundary line having a starting boundary point and an ending boundary point, wherein the controller is configured to generate a plurality of candidate borehole points based on a desired operator spacing and to display the boundary line, the candidate borehole points, current vehicle location, wherein the controller is configured to receive from an operator interface a command selecting a candidate borehole point as a target borehole location.

8. The work vehicle of claim 1, wherein the controller is configured to determine a reach distance of the distal end based on the boom position signal and configured to operate the plurality of ground engaging units based on the reach distance to maintain a target axis longitudinal inclination and a target axis transverse inclination.

9. The work vehicle of claim 8, wherein the controller configured to additionally operate the plurality of ground engaging units based on the received inclinometer signal to maintain the target axis longitudinal inclination and the target axis transverse inclination.

10. A work vehicle having an implement alignment system, the work vehicle comprising:

a frame supported above a ground surface by a plurality ground engaging units, wherein the plurality of ground engaging units are operable to propel and steer work vehicle along the ground surface;

a boom assembly having a near end and a distal end, the boom assembly pivotably coupled to the frame at the near end and extending in a boom direction to the distal end, wherein the boom assembly is configured to pivot the distal end through an arc between an upper position and a lower position;

a work tool pivotably attached to the distal end and coupled to the frame via the boom assembly, the work tool configured to rotate an implement having an implement tip about a tool axis, wherein the work tool has a tool length indicative of the position of the implement tip relative to the distal end, the tool axis having a longitudinal inclination to a vertical axis and a transverse inclination to the vertical axis relative to the boom direction;

a tool axis sensor configured to measure the longitudinal inclination and the transverse inclination of the tool axis, and to generate an inclinometer signal in response;

a boom position sensor configured to measure a pivot position of the implement tip relative to the frame and to generate an arc position signal in response, wherein the arc position signal is indicative of a reach distance and a height of the implement tip relative to the frame;

a controller configured to receive an align command and to operate the ground engaging units to align the tool axis with the vertical at least in part in response to the arc position signal.

11. The work vehicle of claim 10, further comprising a display communicatively coupled to the controller, the controller configured to receive the inclinometer signal from the tool axis sensor and to display tool axis inclination information on the display.

12. The work vehicle of claim 10, further comprising a receiver mounted on the vehicle, and a memory connected to the controller, the memory configured to store a target borehole location, wherein the receiver is configured to receive from each of a plurality of remote wireless transmitters a corresponding position signal, wherein the receiver is configured to determine a current vehicle position based on the received position signals, and wherein the controller is communicatively coupled to receive the current vehicle position from the receiver and configured to determine when a separation distance between the target borehole location and the current vehicle location is below a threshold value.

13. The work vehicle of claim 12, further comprising a boom actuator coupled between the frame and the boom assembly, and actuatable to pivot the boom assembly relative to the frame, wherein the controller is operatively coupled to actuate the boom actuator to pivot the work implement between the upper position and the lower position in response to receiving an operator bore command, wherein the operator bore command includes the tool length, a target borehole depth, wherein the controller is configured to operate the work tool to rotate the implement, and wherein the controller is configured to actuate the boom actuator until the tool tip reaches the target borehole depth while operating the plurality of ground engaging units to maintain the tool axis aligned with the vertical axis.

14. The work vehicle of claim 13, wherein the memory is further configured to store a boundary line having a starting boundary point and an ending boundary point, wherein the controller is configured to generate a plurality of candidate borehole points based on a desired operator spacing and to display the boundary line, the candidate borehole points, and current vehicle location on the display, wherein the controller is configured to receive from an operator interface a command selecting a candidate borehole point as a target location.

15. The work vehicle of claim 10, wherein in response to the align command the controller is configured to operate the ground engaging units to align the tool axis with the vertical axis based on the inclinometer signal and the arc position signal.

* * * * *